US007338562B2

(12) United States Patent
Dionisi et al.

(10) Patent No.: US 7,338,562 B2
(45) Date of Patent: Mar. 4, 2008

(54) SUGAR CANE JUICE CLARIFICATION PROCESS

(76) Inventors: Fabio Alessio Romano Dionisi, Rua Porangaba, 217 (Bosque da Saude), Sao Paulo (BR) 04136-20; Idalina Vieira Aoki, Rua David Ben Gurion, 1604, Apto 131 (Vila Susana), Sao Paulo (BR) 05634-001; Rafael Januario Calabrese, Alameda Arapanes, 628, Apto 61 (Moema), Sao Paulo (BR) 02338-050

( * ) Notice: Subject to any disclaimer, the term of this patent is extended or adjusted under 35 U.S.C. 154(b) by 105 days.

(21) Appl. No.: 11/072,909

(22) Filed: Mar. 4, 2005

(65) Prior Publication Data

US 2005/0229813 A1 Oct. 20, 2005

Related U.S. Application Data

(60) Provisional application No. 60/553,442, filed on Mar. 16, 2004.

(51) Int. Cl.
*C13D 3/06* (2006.01)

(52) U.S. Cl. ..... 127/50; 127/52; 127/57; 127/30

(58) Field of Classification Search ..... 127/52, 127/57, 30

See application file for complete search history.

(56) References Cited

U.S. PATENT DOCUMENTS

| | | | | |
|---|---|---|---|---|
| 1,956,741 | A | 5/1934 | Homberger | |
| 2,093,759 | A | 9/1937 | Hartmann | |
| 2,470,076 | A | 5/1949 | Warren et al. | |
| 2,776,229 | A | 1/1957 | Peterson | |
| 2,992,140 | A | 7/1961 | Gaiennie et al. | |
| 3,097,970 | A | 7/1963 | Delfin | |
| 3,113,045 | A | 12/1963 | Alston | |
| 3,166,443 | A | 1/1965 | Miles | |
| 3,232,793 | A | 2/1966 | Bourne et al. | |
| 3,323,948 | A | 6/1967 | Silver et al. | |
| 3,418,165 | A | 12/1968 | Rabe | |
| 3,479,221 | A * | 11/1969 | Buhl et al. | 127/46.1 |
| 3,508,965 | A | 4/1970 | Harrison et al. | |
| 3,567,512 | A * | 3/1971 | Lyons et al. | 127/48 |
| 3,698,951 | A * | 10/1972 | Bennett | 127/48 |
| 3,806,364 | A * | 4/1974 | Gasco | 127/48 |
| 3,994,743 | A | 11/1976 | Paley | |
| 4,009,706 | A | 3/1977 | Shaughnessey | |
| 4,081,288 | A | 3/1978 | Torres | |
| 5,281,279 | A | 1/1994 | Gil et al. | |
| 5,932,016 | A * | 8/1999 | Paananen et al. | 127/48 |
| 6,174,378 | B1 | 1/2001 | Donovan et al. | |
| 6,368,413 | B1 * | 4/2002 | Charlet et al. | 127/46.1 |

FOREIGN PATENT DOCUMENTS

| | | |
|---|---|---|
| CS | 145664 | 10/1972 |
| DD | 131179 | 6/1978 |
| DE | 4437201 | 4/1996 |
| GB | 1279370 | 6/1972 |
| IN | 43812 | 6/1952 |
| IN | 45146 | 9/1952 |
| IN | 158322 | 6/1985 |
| JP | 61111700 | 5/1986 |
| JP | 63089485 | 4/1988 |
| JP | 1993017274 A | 1/1993 |
| JP | 1994121981 A | 5/1994 |
| JP | 2001258600 A | 9/2001 |
| JP | 2002020299 A | 1/2002 |
| JP | 2004321174 A | 11/2004 |
| RU | 2078826 | 5/1997 |
| RU | 2155814 | 9/2000 |
| RU | 2244010 | 1/2005 |
| SU | 1013478 | 4/1983 |
| SU | 1806203 | 4/1983 |
| WO | WO 2004 090171 | 10/2004 |

OTHER PUBLICATIONS

Tempany, H.A., The Manufacture of Cain Sirup (?sp.), Louisiana Planter (1914), 51, 226 Journal.

Khainovsky, V., The Effect of Colloids on the Viscosity of Sugar Cane Molasses, Arch. Suikerind (1972), 29, 1344-7, Journal (also copy of abstract).

Mallea, Oscar S., et al., Clarification of Cane Juice with Colloidal Sodium Bentonite. The Use of Colloidal Bentonite in Argentina, Bol. estac. exptl. agr. Tucuman (1952), No. 68, 15-24, Journal (also copy of abstract).

Vignes, E.C., Effect of Temperature on Rate of Reaction During Liming, Annual Report - Mauritius Sugar Industry Research Institute (1968) 117-20 CODEN; MSIRAB: ISSN: 0369-2043, Journal.

* cited by examiner

*Primary Examiner*—David M. Brunsman

(57) ABSTRACT

A process to clarify raw sugar cane juice, which comprises adding a source of lime, adding an anionic inorganic colloid or polyacyrlamide, and carbonating.

20 Claims, No Drawings

SUGAR CANE JUICE CLARIFICATION PROCESS

FIELD OF THE INVENTION

The invention refers to an enhanced process to clarify raw sugar cane juice by means of the use of an anionic inorganic colloid or polyacrylamide polymer, particularly together with a carbonating process.

BACKGROUND OF THE INVENTION

Sugar cane juice is an extremely complex liquid medium, containing many organic and inorganic constituents in soluble, suspended/decantable and suspended/colloidal form. Cane sugar for human consumption is produced by means of clarification of sugar cane juice using an extraction process, which is then processed and concentrated to obtain sugar.

Clarification is therefore an essential step to obtain high yields and high quality of the sugar. The clarification process needs to remove components other than sucrose and, at the same time, minimize loss of sucrose and color formation.

Sulfitation is currently the most widely used process to clarify cane juice. It consists of $SO_2$ (sulphurous anhydride) absorption by the juice, reducing its original pH to levels between 3.7 and 4.2. The use of the sulfitation process involves: (a) inhibition reactions causing color formation; (b) coagulation of suspended colloids; and (c) formation of a precipitate of $CaSO_3$ (calcium sulfite). Furthermore, it also reduces the viscosity of the juice and consequently of the syrup, massecuites, and molasses, facilitating evaporation and baking operations.

Nevertheless, the sulfitation process has problems which the sugar/alcohol industry would like to be solved, including (a) sucrose inversion due to low pH during the process; (b) potential environmental and external corrosion problems in the area, caused by any emission of $SO_2/SO_3$; (c) incrustation and corrosion of the evaporation equipment; and (d) presence of sulfite in the final sugar.

Another method to clarify sugar cane juice is carbonation, which generally employs treatment with lime and controlled addition of carbon dioxide ($CO_2$). However, this process results in (a) increase in the loss of inverted sugar in the juice (fructose and glucose) due to the high alkaline pH (generally pH of about 10) and the high temperatures used for the process, adversely affecting yield of alcohol production from the final molasses, and (b) difficulty in filtering the precipitates from clarifiers, requiring a higher investment in equipment, higher operational costs and a more complex operation.

Therefore, there is a desire to have a clarification process which is superior to the sulfitation process, but which avoids the problems with carbonation. The present invention provides such a process.

Silicate microgels are used in water purification and water flow processes. WO 99/61377 discloses a process to clarify water streams containing biosolids resulting from processing food and organic residues, which comprises contact of the stream with an anionic colloid, which may be a silicate microgel, and an organic polymer to flocculate the biosolids.

For sugar cane juice clarification it is desired to minimize the accumulation of silica in the juice and in production heating equipment. The process of the present invention resolves this problem while avoiding the problems with the prior art sulfitation and carbonation processes.

SUMMARY OF THE INVENTION

The invention comprises a sugar cane juice clarification process comprising at least the steps of addition of lime; addition of anionic inorganic colloid, a polyacryamide polymer, or both said colloid and said polymer; and carbonation.

More specifically, the invention comprises an improved process to clarify sugar cane juice by carbonating, comprising the addition of an anionic inorganic colloid or polyacrylamide polymer, according to the following steps:

a) heating of the raw sugar cane juice to be clarified;
b) adding a source of lime;
c) adding an anionic inorganic colloid, a polyacrylamide polymer, both the said colloid and polymer sequentially, or a mixture thereof;
d) carbonating by adding carbon dioxide; and
e) decanting precipitates formed to yield a supernatant containing sugar cane juice.

Optionally, the addition in step c) can be after, instead before, the step d) carbonation; i.e., downstream of the carbonating step.

The process optionally further comprises:

a) heating of the supernatant from step e) above;
b) carbonating by adding carbon dioxide; and
c) decanting any precipitates formed to yield a further supernatant containing sugar cane juice.

DETAILED DESCRIPTION OF THE INVENTION

According to a specific embodiment of the invention, the clarification process of the present invention comprises the steps of:

a) heating of the raw sugar cane juice to be clarified;
b) adding a source of lime;
c) adding an anionic inorganic colloid, or a polyacrylamide polymer, or both the said colloid and polymer sequentially, or a mixture of said colloid and said polymer;
d) carbonating by adding carbon dioxide; and
e) decanting precipitates formed to yield a supernatant containing sugar cane juice.

In particular, the present invention provides an improved process for clarifying raw sugar cane juice using carbonation wherein the improvement comprises addition of an anionic inorganic colloid, a polyacrylamide polymer, both said colloid and polymer sequentially, or a mixture of said colloid and said polymer. The preferred anionic inorganic colloid is silicate microgel.

During step a), raw sugar cane juice is heated to a temperature between about 45° C. and about 90° C., preferably between about 50° C. and about 85° C., and still more preferably between about 55° C. and about 80° C. Juice heating has the purpose of facilitating downstream processes by speeding up chemical reactions and improving the coagulation and sedimentation of colloids and others non-sugars.

The liming step b) is the addition of a source of lime (CaO) to the raw cane juice. Any suitable source of lime can be employed, but lime milk ($Ca(OH)_2$) or calcium saccharate are preferred. The addition of the source of lime raises the pH of the sugar cane juice. Lime is added up to a maximum concentration of about 2% by weight of the solids content of the juice. This addition has the purpose of eliminating juice colorants, neutralizing organic acids, and forming calcium phosphate precipitate, which upon sedimentation carries with it the impurities present in the liquid.

Between steps b) and c), it is particularly advantageous that a time interval of between about 0.5 and about 10 minutes is optionally observed.

In step c) of the process of the present invention an anionic inorganic colloid is added. Such colloids useful in the process of this invention include silica-based anionic inorganic colloids and mixtures thereof. Silica-based anionic inorganic colloids include, but are not limited to, colloidal silica, aluminum-modified colloidal silica, polysilicate microgels, polyaluminosilicate microgels, polysilicic acid, and polysilicic acid microgels, and mixtures thereof. For those colloids containing aluminum, the aluminum can be on the surface and/or in the interior of the particles.

The anionic inorganic colloids used in this invention can be in the form of a colloidal silica having an S value >70%, generally >75%, and containing about 2 to 60% by weight of $SiO_2$, preferably about 4 to 30% by weight of $SiO_2$. The colloid can have particles with at least a surface layer of aluminum silicate or it can be an aluminum modified silica sol. The alumina content of the surface-modified silica sol can be in the range of 2 to 25%. The colloidal silica particles in the sols commonly have a specific surface area of 50–1200 $m^2/g$, more preferably about 200–1000 $m^2/g$. The silica sol can be stabilized with alkali in a molar ratio of $SiO_2$:$M_2O$ of from 10:1 to 300:1, preferably 15:1 to 100:1, and most preferably 6:1 to 12:1 (M is Na, K, Li, or $NH_4$).

Preferred for use in the process of the present invention are silicate microgels. Microgels are distinct from colloidal silica in that the microgel particles usually have surface areas of 1000 $m^2/g$ or higher and the microgels are comprised of small 1–2 nm diameter silica particles linked together into chains and three-dimensional networks. Polysilicate microgels, also known as active silicas, have $SiO_2$:$Na_2O$ ratios of 4:1 to about 25:1, and are discussed on pages 174–176 and 225–234 of "The Chemistry of Silica" by Ralph K. Iler, published by John Wiley and Sons, N.Y., 1979. Polysilicic acid generally refers to those silicic acids that have been formed and partially polymerized in the pH range 1–4 and comprise silica particles generally smaller than 4 nm diameter, which thereafter polymerize into chains and three-dimensional networks. Polysilicic acid can be prepared in accordance with the methods disclosed in U.S. Pat. Nos. 5,127,994 and 5,626,721. Polyaluminosilicates are polysilicate or polysilicic acid microgels in which aluminum has been incorporated within the particles, on the surface of the particles, or both. Polysilicate microgels, polyaluminosilicate microgels and polysilicic acid can be prepared and stabilized at acidic pH. Microgel size can be increased by any of the known methods such as of aging of the microgel, changing pH, changing concentrations, or other methods, known to those skilled in the art. The use of silicate microgels provides the advantage in the process of the present invention of reducing scaling in equipment, and therefore equipment and maintenance cleaning problems.

The polysilicate microgels and polyaluminosilicate microgels useful in this invention are commonly formed by the activation of an alkali metal silicate under conditions described in U.S. Pat. Nos. 4,954,220 and 4,927,498. However, other methods can also be employed. For example, polyaluminosilicates can be formed by the acidification of silicate with mineral acids containing dissolved aluminum salts as described in U.S. Pat. No. 5,482,693. Alumina/silica microgels can be formed by the acidification of silicate with an excess of alum, as described in U.S. Pat. No. 2,234,285.

In addition to conventional silica sols and silica microgels, silica sols such as those described in European patents EP 491879 and EP 502089 can also be used for the anionic inorganic colloid in this invention. These are commonly referred to as low "S value" sols. EP 491879 discloses a silica sol having an S value in the range of 8 to 45% wherein the silica particles have a specific surface area of 750 to 1000 $m^2/g$, which have been surface-modified with 2 to 25% alumina. EP 502089 discloses a silica sol having a molar ratio of $SiO_2$ to $M_2O$, wherein M is an alkali metal ion and/or an ammonium ion of 6:1 to 12:1 and containing silica particles having a specific surface area of 700 to 1200 $m^2/g$.

Included within the scope of colloidal silica sols useful in the present invention are colloidal silica sols having a low "S value". S value is defined by Iler and Dalton in *J. Phys. Chem.,* 1956, vol. 60, pp. 955–957. S value is a measure of the degree of aggregate or microgel formation and a lower S value indicates a higher microgel content and is determined by the measure of the amount of silica, in weight percent, in the disperse phase. The disperse phase consists of particles of anhydrous silica together with any water that is immobilized at the surface or in the interior of the particles.

In the process of the present invention the preferred silicate microgel is added to the mixture of sugar cane juice and lime source in step c), preferably at a quantity of between about 50 ppm and about 500 ppm, more preferably from about 50 ppm to about 200 ppm. Silicate microgels are commercially available, such as Particlear® manufactured by E.I. du Pont de Nemours and Company of Wilmington Del., and are produced by any method known in the art. U.S. Pat. No. 6,060,523 and U.S. Pat. No. 6,274,112 disclose enhanced processes allowing reliable preparation of the microgels. Silicate microgel typically is obtained from sodium silicate. It is also designated as silicon dioxide microgel or active silica, comprising between about 0.5% and 2% $SiO_2$, particularly about 1% $SiO_2$ solution.

Alternatively, a polyacrylamide polymer is employed in step c) of the process of the present invention. A quantity of from about 1 ppm to about 10 ppm is employed, preferably from about 2 ppm to about 5 ppm. Suitable polyacrylamide polymers for use herein include mainly anionic polymers, which carry the same charge as the particles of the suspension in raw juice. Preferred are partially hydrolyzed polyacrylamides having a moderate degree of hydrolysis (between about 15% and about 40% hydrolyzed). The polymer molecular weights usually are above 1,000,000. Suitable polyacrylamides are available commercially, for example from Kemwater Brasil S.A., Sao Paulo, Brazil.

The silicate microgel and polyacrylamide can both be used in the process of the present invention by adding them sequentially in any order or as a mixture. Use of the silicate microgel is preferred due to faster dewatering during filtration resulting in better filtration.

Applicant has developed an enhanced carbonating process for cane juices, comprising the addition of an anionic inorganic colloid, preferably silicate microgel, and adjusting it to the operating conditions of a modified and improved carbonating process, thus solving the problems for its industrial implementation and permitting higher yields of purer sugar. The process of the present invention recovers the waste $CO_2$ from fermenters and replaces $SO_2$ currently used in the sulfitation process for juice clarification with the recovered $CO_2$. It also lowers scale formation in evaporators and heat-exchangers by removal of scale forming compounds from the juice through the improved clarification process. Furthermore, the process of the present invention solves the problem of filtering the precipitates/sedimentation generated by the traditional carbonation processes, and does not increase the loss of inverted sugars. Furthermore, the process of the present invention reduces the consumption of CaO in comparison with the traditional carbonation processes.

The process of the present invention reduces sucrose losses by inversion, obtains better purification of the cane juice by removal of more organic and inorganic impurities, reduces corrosion of equipment due to the absence of $SO_2$, lowers scaling in evaporators, and provides improved sugar production.

According to a preferred embodiment of the invention, the microgel is activated by an acid, particularly from $CO_2$, because $CO_2$ is abundant at sugar cane processing facilities that produce ethanol by fermentation of juice and/or molasses.

A time interval between step c) and the subsequent one is advantageous and this time interval is typically between 0.5 and about 10 minutes.

In step d), $CO_2$ is added, preferably in sufficient quantity to form calcium carbonate precipitates. The flow of $CO_2$ is regulated to control foaming and reaction time. In a preferred embodiment of the present invention, the $CO_2$ is added through a carbonation column, in counter flow with the limed raw sugar juice source fed into the top of the column.

Optionally the anionic inorganic colloid, or the polyacrylamide, or each of the former, or a mixture thereof, can be added after the carbonating step instead of prior to the carbonating step in the amounts previously disclosed.

After the carbonation step, the decanting step e) is undertaken. In step e), the sugar cane juice is purified by removing precipitated impurities as solids. The decanted juice is removed from the upper part of the decanter and delivered to an evaporator, where it is concentrated. The precipitated and sedimented materials have a solid concentration of about 10° Bé and are usually taken from the bottom of the decanter and sent to a filtering sector where the materials are subsequently filtered to recover sugar. According to the invention, the required decanting time is less than one hour, usually about 30 minutes. The pH of the supernatant, after this first carbonation, is usually between about 8 and 10, preferably about 9.

The carbonation process of the present invention is particularly advantageous when conducted using the final supernatant as the starting material in a second carbonation. Thus, the present invention further comprises a carbonation process which, in addition to the above-disclosed steps, additionally comprises the following steps:

a) heating of supernatant resulting from the above-described process;

b) carbonating by adding carbon dioxide; and c) decanting any solids precipitated to yield a further supernatant containing sugar cane juice.

During step a), the supernatant is heated at temperatures between about 60° C. and 90° C., preferably about 70° C. Heating is followed by a carbonation step. Operating conditions are employed which avoid excessive foam formation and generate the expected neutral pH for the juice. In a preferred embodiment, $CO_2$ is added through a second carbonation column, in counter flow with the clarified juice fed into the top of such column. This column adjusts the final pH of the treated juice. The final pH is typically from about 6.5 to about 8, preferably about 7. Any solids precipitated are decanted to yield a further supernatant containing sugar cane juice. Often there are no precipitants formed during the second carbonation.

The process of the present invention as disclosed herein makes use of carbonation to clarify sugar cane juice, presenting advantages over the sulfitation process in higher yields with better quality product.

The elimination of use of sulfur in the process of the present invention represents a noticeable advantage, not only in cost, but also resulting in higher process safety, lower corrosion and/or scaling of heating equipment, and less environmental degradation.

Sucrose inversion in the process of the invention is reduced by between about 1.5% and 2.5%, which represents a yield increase. As a direct consequence of this aspect a higher yield in crystal sugar production is obtained using the same equipment, since sucrose forms sugar crystals and not reducing sugars. This single standard demonstrates that the process of the present invention is significantly better than those in the prior art.

The process of the present invention results not only in a lower loss of sucrose, but also in higher removal of non sugars such as starches, proteins, solids in suspension and dissolved solids. The protein and starch are surprisingly reduced, typically to less than 3 ppm in the clarified juice.

The process of the present invention yields purer product with better physical features such as color. The purity (Purity=POL/Brix) may increase for two different reasons: (i) higher content of sucrose (higher numerator) or (ii) lower content of non-sugars (lower denominator). Higher reduction in sucrose inversion favors further crystallization since the process will suffer less interference from impurities.

The lower quantity of impurities is very desirable and benefits the whole operation, since it reduces the overall volume to be processed throughout the system. Therefore, there is less incrustation/scaling in the heating equipment, especially the evaporator, which then does not need to be cleaned so frequently. This reduces maintenance and steam energy costs and increases safety for employees who conduct such cleaning operations at the industrial facility.

Furthermore, the impurity reduction provided by the process of the present invention, results in much higher sugar quality. Impurities and color (standard Icumsa (420 nm)) are reduced improving its market value. A color measure of the clarified sugar juice having a maximum of 7100, preferably a maximum of 6000, and more preferably a maximum of 5000, is attainable.

Besides being a safer process with superior product, the process of the present invention provides a reduction in impurities in the juice between about 1.5% and 2.0%. For all of the above reasons, the process provides increased efficiency overall. Fewer impurities are processed under the same installed capacity, thus increasing sugar production.

This increase in sugar production does not affect alcohol production from the molasses. Reducing sugars remain in the final molasses and can be converted to ethanol. Therefore, due to the reduction in sucrose inversion, there will be less final molasses for alcohol production. But, to keep the same desired levels, it is only required to deviate more raw juice to the distillery, skipping the clarification, evaporation and vacuum steps of the process.

In addition to the above advantages, the process of the present invention improves the reduction of juice turbidity, reduction of organic colloids (e.g. starch), and improved coagulation and flocculation. In particular, the time to form flakes is reduced and the size of the flakes is reduced. Thus sedimentation time is reduced overall. A further advantage is the optional elimination of the addition of flocculating agents.

The carbonation process of the present invention is especially advantageous for use at temperatures between about 70° C. and about 80° C., thus avoiding a negative effect on yield of alcohol production from the final molasses. Simultaneously, energy cost and decanting time are reduced. Keeping the juice at an elevated temperature leads to inversion and reducing sugar degradation to form organic acids, resulting in a decrease in purity and pH. The reduction in decanting time of the process of the invention reduces the loss of sugar by inversion.

The fact that the new process generates precipitates/sediment with easier filtering characteristics than traditional carbonation is exceptionally advantageous to the sugar/alcohol industry. The sediment resulting from traditional carbonation is difficult to filter, requiring the installation of pressing filters, representing a large financial investment and a more complicated process. This is one of the main reasons why the prior art carbonation process is not more widely used. The process of the present invention generates precipitates/sediment which does not require the installation of press filters, since vacuum rotating filters can be used.

Besides better filtering, the precipitates/sediment resulting from the process of the invention comprises a lower quantity of sucrose. The loss of sucrose represents less than 0.4% of the total sugar entering the plant, thus representing approximately half of the current losses. Furthermore, as opposed to traditional carbonation processes, lime consumption is much lower. It is less than 2% by weight of solids present in the juice. In the traditional carbonation processes, the lime consumption is between 6 to 10% by weight of solids present in the juice.

Thus, the process of the invention is a faster and safer process, results in a significant increase in yield, generates superior quality, and avoids the problems in the conventional carbonation process. It is useful to clarify sugar cane juice more efficiently.

As the experts in the art will realize, numerous modifications and variations of the scope of the invention are possible in the light of the above teachings. It should therefore be understood that the invention can be embodied in other ways besides those specifically described herein.

EXAMPLES

Raw sugar cane juice from the past crop season typically had the following properties: pH of 5.2–5.8, turbidity of 5000, color of 10,000 to 12,000 using the ICUMSA Method #4, Brix of 14 to 16, and total reducing sugars of 13 to 15.

Example 1

Raw sugar cane juice (1 liter) was heated slowly to 80° C. in a 2 liter beaker, followed by gradual addition of 33 ml of liming milk (calcium hydroxide, $Ca(OH)_2$) to raise the pH to 8.5. The solution was maintained for about one (1) minute, following which was added 160 ppm silica microgel available as Particlear® from E.I. du Pont de Nemours and Company, Wilmington, Del. The solution was then held for about 2 minutes. The pH of the solution was kept at 8.4 via simultaneous addition of liming milk and carbon dioxide gas. Liming milk (105 mL) was added to reach a total of 2% CaO by weight on solids content. The carbon dioxide was introduced at a steady rate of 260 cc/minute. Finally, the pH of the solution is lowered to 7.0 by bubbling additional carbon dioxide into the solution. Total carbonation time was 15 minutes. During carbonation, foam formation was controlled by regulating the $CO_2$ flow rate and due to the presence of microgel. The precipitate volume (in the original carbonation beaker) was 160 mL after 45 minutes of sedimentation.

This was followed by a filtration step, whereby 100 mL of the concentrated precipitate was filtered in a vacuum of 58 mm Hg (7733 Pa). Filtration time for a 75 ml sample was 6 minutes, with a time to cake dryness of 8 minutes. The final pH of both the filtrate and the supernatant liquid sugar juice was 7.9. The supernatant juice and vacuum filtered juice were analyzed for pH, color, turbidity, Brix, and total reducing sugars. Excellent clarity and transparency of the juice was evident during the process. The turbidity of the final sugar juice was 16 NTU, and its color was 6436 measured using the ICUMSA method #4. The Brix was 17.8. Total reducing sugars was 16.7.

Comparative Example A

Sugar cane juice was processed in the mill using the sulfitation process. The juice was contacted with $SO_2$ and liming milk (calcium hydroxide, $Ca(OH)_2$) to form a precipitate of calcium sulfite ($CaSO_3$). The coagulated precipitate was then separated from the supernatant. The product had a pH of 6.5, color of 9030 using ICUMSA Method #4, Brix of 15.8, Total reducing sugars of 14.6, and sulfites of 150.

Example 2

Raw sugar cane juice was processed as in Example 1. The final product had a pH of 8, turbidity of 54 NTU, color of 7096 using the ICUMSA Method # 4, Brix of 17.0 and Total reducing sugars of 16.2.

Example 3

Raw sugar cane juice was processed continuously in a pilot plant using 2 to 3 liters of juice per hour and running 3 to 4 hours per day using the process of the present the invention. Raw sugar cane juice was heated to 55° C., followed by addition of liming milk (calcium hydroxide, $Ca(OH)_2$) to raise the pH to 10.5. Liming milk consumption was about 1.2% CaO by weight on solids content. The solution was maintained for about five (5) minutes. The solution was then carbonated in a counter flow column. The carbon dioxide was introduced from the bottom, at a steady flow rate, in order to get a final carbonated juice pH of 9.5, downstream of the column. In the column, the carbonation time was 10 minutes. Following which was added 150 ppm silica microgel available as Particlear® from E.I. du Pont de Nemours and Company, Wilmington, Del. The solution was then held for about 5 minutes. The microgel-carbonated juice was then sent to a decanter in order to separate the precipitate from the clarified juice (supernatant). Finally, the supernatant was heated up to 70° C., and the pH of this heated solution was lowered to 7.0 by bubbling additional carbon dioxide into the solution, in a second counter flow carbonation column. The precipitate from the decanter was sent for characterization and the results are given in Table 1 and 2 below.

Table 1 compares the properties of the sugar juice made using the process of the present invention according to Example 3 to average results reported in the literature for carbonation processes not employing silica microgel.

TABLE 1

| Attribute | Carbonation, Literature Averages | Carbonation with Microgel |
|---|---|---|
| pH | 8.1 | 7.2 |
| Sucrose, wt % | 13.5–14 | 14.7 |
| Color | 10900 | 4943 |
| Brix | 15.8 | 16.7 |
| POL | 12.6 | 15.1 |
| Purity (POL/BRIX) | 82.5 | 88.7 |
| Total Reducing Sugars | 13 | 15.8 |
| Starch | 90 | 0 |
| CaO over solids (% wt) | 2 | 1.2 |

Table 1 shows improvement in color, brix, purity, starch, and total reducing sugars using the process of the present invention.

Table 2 compares the properties of the sugar juice made using the process of the present invention according to Example 3 to average results reported in the mills for sulfitation processes.

TABLE 2

| Attribute | Sulfitation, Mill Averages | Carbonation with Microgel |
|---|---|---|
| pH | 7.0 | 7.2 |
| Sucrose, wt % | 13.5–14 | 14.7 |
| Color | 6000 | 4943 |
| Brix | 15.5 to 16 | 16.7 |
| Purity (POL/BRIX) | 82 to 85 | 88.7 |
| Total Reducing Sugars | 13 to 15 | 15.8 |
| Reducing Sugars | 0.4 to 0.6 | 0.53 |
| Starch | 70 to 100 | 0 |
| % CaO (clarified juice) | 0.10 | 0.11 |

Table 2 shows improvement in color, brix, purity, starch, sucrose, and total reducing sugars using the process of the present invention.

Examples 4–12 and Comparative Examples A–F

Carbonated materials from the process of Example 3 were filtered using 200 ml suspension volume at three different pressures as indicated in Table 3 using a Bokela filter device, available from Bokela, Karlsruhe, Germany. Materials from a traditional sulfitation process were filtered under the same conditions. The material using the process of the present invention showed solids which were fiber like and formed a filter cake of 16–27% solids, which was easier and faster to dewater. In contrast, material from the comparative sulfitation process formed a gel-like filter cake of about 23% solids, which was more difficult to dewater. Turbidity of the resulting sugar juice (filtrate) was about 11,000–12,000 NTU for the comparative sulfitation process and about 4,000–5,000 NTU for the process of the present invention. Specific results are listed in Table 3 below.

TABLE 3

| Sample Identity | Over pressure (Pa) | Filtrate turbidity (NTU) | Cake Height (mm) | Overall time (sec) | Cake (% solid) |
|---|---|---|---|---|---|
| Comparative Example A - (Sulfitation) | $0.3 \times 10^5$ | 12252 | 15.9 | 1747.0 | 23.02 |
| Comparative Example B - (Sulfitation) | $0.6 \times 10^5$ | 11566 | 17.1 | 1660.0 | 23.65 |
| Comparative Example C - (Sulfitation) | $1.2 \times 10^5$ | 12442 | 16.0 | 614.0 | 23.30 |
| Example 4 - (Microgel) | $0.3 \times 10^5$ | 4743 | 29.5 | 113.0 | 21.54 |
| Example 5 - (Microgel) | $0.6 \times 10^5$ | 4929 | 27.3 | 107.0 | 27.61 |
| Example 6 - (Microgel) | $1.2 \times 10^5$ | 4981 | 29.7 | 70.0 | 16.25 |

Additional runs were performed as described above in order to also compare the carbonation method of the present invention using silicate microgel with (a) the carbonation process of the present invention using polyacryamide polymer instead of silicate microgel, and (b) the traditional prior art carbonation process. Results are indicated below in Table 4.

TABLE 4

| Sample Identity | Over pressure (Pa) | Filtrate turbidity (NTU) | Cake Height (mm) | Dewatering time (sec) | Cake (% solid) |
|---|---|---|---|---|---|
| Comparative Example D - (traditional carbonation) | $0.3 \times 10^5$ | 6342 | 10.4 | 6.3 | 22.32 |
| Comparative Example E - (traditional carbonation) | $0.6 \times 10^5$ | 6514 | 5.9 | 7.7 | 21.48 |
| Comparative Example F - (traditional carbonation) | $1.2 \times 10^5$ | 6380 | 9.0 | 4.4 | 23.13 |
| Example 7 - (microgel carbonation) | $0.3 \times 10^5$ | 5479 | 9.0 | 4.5 | 23.19 |
| Example 8 - (microgel carbonation) | $0.6 \times 10^5$ | 5474 | 8.7 | 3.3 | 23.82 |
| Example 9 - (microgel carbonation) | $1.2 \times 10^5$ | 5425 | 8.2 | 3.8 | 23.81 |
| Example 10 - (polymer carbonation) | $0.3 \times 10^5$ | 6015 | 6.5 | 7.4 | 21.81 |
| Example 11 - (polymer carbonation) | $0.6 \times 10^5$ | 5916 | 8.7 | 7.1 | 23.39 |
| Example 12 - (polymer carbonation) | $1.2 \times 10^5$ | 5900 | 8.0 | 7.7 | 24.97 |

Also in this case, according to above results, the material using the process of the present invention showed percent solids in the cake similar to Examples 4–6 above. However, as in the comparison with sulfitation process, the filtrate turbidity from the process of the present invention using silicate microgel or polyacrylamide was better and the filtration of the cake was easier. The process of the present invention using silicate microgel was faster to dewater. In addition, in terms of filter operation, the cake from the carbonation process of the present invention using the silicate microgel released better from the filter screen, in comparison with the other processes.

What is claimed is:

1. A process to clarify raw sugar cane juice comprising the steps of addition of a source of lime; addition of an anionic inorganic colloid, a polyacryamide polymer, or both said colloid and said polymer;

and carbonation.

2. The process of claim 1 comprising the following steps:

a) heating of the raw sugar cane juice to be clarified;

b) adding a source of lime;

c) adding an anionic inorganic colloid, a polyacrylamide polymer, both the said colloid and polymer sequentially, or a mixture thereof;

d) carbonating by adding carbon dioxide; and e) decanting precipitates formed to yield a supernatant containing sugar cane juice.

3. The process of claim 2 further comprising the following additional steps:

a) heating of supernatant;

b) carbonating by adding carbon dioxide; and c) decanting any precipitates formed to yield a further supernatant containing sugar can juice.

4. The process of claim 3 wherein the supernatant has a maximum color of 6000.

5. The process of claim 3 wherein the supernatant is heated at temperatures between about 60° C. and about 90° C.

6. The process of claim 5 wherein the carbon dioxide is added in an amount sufficient to lower the pH of the sugar cane juice supernatant to about 7.0.

7. The process of claim 2 wherein the anionic inorganic colloid is a silicate microgel.

8. The process of claim 7 wherein the silicate microgel is added after the step d) instead before step d).

9. The process of claim 4 wherein the silicate microgel is added in an amount from about 50 ppm to about 500 ppm.

10. The process of claim 7 wherein the addition of silicate microgel is conducted after a period of from about 0.5 to about 10 minutes after adding lime.

11. The process of claim 7 wherein the carbon dioxide is added after a time interval of from about 0.5 to about 10 minutes has elapsed after the addition of silicate microgel.

12. The process of claim 2 wherein the polyacrylamide polymer or polyacrylamide and silicate microgel are added after the step d) instead of before step d).

13. The process of claim 2 in wherein the raw sugar cane juice is heated at a temperature between about 45° C. and about 90° C.

14. The process of claim 2 wherein the lime is added to the raw cane juice to achieve a maximum concentration of 2% by weight of solids of the raw cane juice.

15. The process of claim 14 wherein the lime is in the form of lime milk ($Ca(OH)_2$) or calcium saccharate.

16. The process of claim 2 wherein the polyacrylamide polymer is added in an amount from 1 ppm to 10 ppm.

17. The process of claim 2 wherein the precipitates have a solid concentration of about 10° Baumé, and said precipitates are subsequently decanted to separate the purified sugar cane juice from the precipitates.

18. The process of claim 2 wherein decanting time is less than one hour.

19. The process of claim 2 wherein the final pH of the supernatant is from about 6.5 to about 8.

20. The sugar cane juice produced by the process of claim 1.

* * * * *